US007913888B2

(12) United States Patent
Blessing et al.

(10) Patent No.: US 7,913,888 B2
(45) **Date of Patent: *Mar. 29, 2011**

(54) POSITIONING DEVICE WITH ACTUATING SWITCHING MEANS FOR A HAND-HELD SETTING TOOL

(75) Inventors: Matthias Blessing, Frastanz (AT); Walter Schaepper, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 266 days.

This patent is subject to a terminal disclaimer.

(21) Appl. No.: 12/156,190

(22) Filed: May 29, 2008

(65) Prior Publication Data

US 2008/0296338 A1 Dec. 4, 2008

(30) Foreign Application Priority Data

Jun. 1, 2007 (DE) ..... 10 2007 000 303

(51) Int. Cl.
*B25C 1/08* (2006.01)

(52) U.S. Cl. ..... 227/8; 227/9; 227/10

(58) Field of Classification Search ..... 227/8–10, 227/156; 173/8–10; 42/70.09
See application file for complete search history.

(56) References Cited

U.S. PATENT DOCUMENTS

| | | | | | |
|---|---|---|---|---|---|
| 443,747 | A * | 12/1890 | Von Derschau | 42/70.09 |
| 908,982 | A * | 1/1909 | Ely | 42/70.09 |
| 953,279 | A * | 3/1910 | Moore | 42/70.01 |
| 960,185 | A * | 5/1910 | Moore | 42/70.09 |
| 2,041,661 | A * | 5/1936 | Lepp | 42/70.05 |
| 2,273,204 | A * | 2/1942 | Kneubuehl | 42/70.09 |
| 3,081,998 | A * | 3/1963 | Weiss | 273/440 |
| 4,479,599 | A * | 10/1984 | Conrad | 227/9 |
| 5,429,291 | A * | 7/1995 | Thompson | 227/10 |
| 5,465,893 | A * | 11/1995 | Thompson | 227/8 |
| 5,518,161 | A * | 5/1996 | Thompson | 227/8 |
| 7,014,085 | B2 * | 3/2006 | McCullough | 227/8 |
| 7,090,107 | B2 * | 8/2006 | Buechel et al. | 227/8 |
| 7,213,359 | B2 * | 5/2007 | Beretta | 42/70.08 |
| 7,228,917 | B2 * | 6/2007 | Davis et al. | 173/170 |
| 7,258,261 | B1 * | 8/2007 | Reyes | 227/110 |
| 7,565,991 | B2 * | 7/2009 | Erhardt | 227/8 |
| 2005/0121487 | A1 * | 6/2005 | Buechel et al. | 227/10 |
| 2006/0277808 | A1 * | 12/2006 | Danner et al. | 42/70.09 |
| 2008/0302849 | A1 * | 12/2008 | Blessing et al. | 227/110 |

* cited by examiner

*Primary Examiner* — Rinaldi I. Rada
*Assistant Examiner* — Lindsay Low
(74) *Attorney, Agent, or Firm* — Abelman, Frayne & Schwab

(57) ABSTRACT

A positioning device for a hand-held setting tool (10) includes an actuation element (24), a switching link (30) for connecting an actuation element (24) to the actuation switch (13) of the setting tool (10) for actuating the same, and a safety device (50) for preventing actuation of the actuation switch (13) at an orientation other than a predetermined orientation of the setting tool (10) and including at least three blocking members (55*a*, 55*b*, 55*c*) displaceable in at least three separate channels (56), respectively, and receivable in a recess (51) formed in a switching member (34), that forms part of the switching link (30) a longitudinal axis with the at least three channels (56) intersecting, in some regions, an axial projection of the switching member (34) in the form of a secant and opened toward the switching member (34) in respective overlapping regions (59).

8 Claims, 6 Drawing Sheets

POSITIONING DEVICE WITH ACTUATING SWITCHING MEANS FOR A HAND-HELD SETTING TOOL

BACKGROUND OF THE INVENTION

1. Field of the Invention

The present invention relates to a positioning device for a hand-held setting tool having an actuation switch for actuating the setting tool, with the positioning device including a rod-shaped holder defining a longitudinal axis, connection means for the setting tool arranged at an end of the holder, actuating switching means for actuating the actuation switch of the setting tool and including an actuation element, a switching link that connects the actuation element with the actuation switch of the setting tool, and a safety device for preventing actuation of the actuation switch of the setting tool at an orientation of the setting tool other than a predetermined orientation.

2. Description of the Prior Art

Positioning devices of the type described above are used, e.g., at overhead works with hand-held setting tools in case of high ceilings when working is possible only using working platforms or ladders. Setting tools, which can be used with such devices, can be driven with solid, gaseous, or liquid fuels or with compressed air or electricity.

U.S. Pat. No. 4,479,599 discloses a positioning and actuation device for a combustion-operated setting tool and including connection means for the setting tool, which is arranged at an end of an elongated holder formed as a rod or a bar. The rod or bar is axially displaceable relative to the connection means for actuating the actuation switch of the setting tool that is secured on the connection means via coupling means. For actuating the setting tool, the tool should be placed with its muzzle part against a ceiling and then be displaced in the direction of the ceiling with the holder or rod by the user.

Further, the positioning and actuation device has a safety device which prevents the setting tool from being actuated when the muzzle part is oriented exactly in direction of the force of gravity. For this purpose, the safety device has a blocking member formed as a ball which is guided in a recess formed as a channel and extending in the connection means diagonally to the longitudinal axis of the rod. At an orientation of the tool in the direction of the gravitational force, the ball rolls into the movement path of the rod and prevents a further movement of the rod relative to the connection means and, therefore, prevents actuation of the setting tool secured on the connection means. To this end, the rod has, at its end adjacent to the connection means, a radially circumferential recess into which the ball can fall.

The drawback here consists in that the actuation of the setting tool can only be safely prevented when the positioning and actuation device with the setting tool is oriented exactly with the muzzle part facing in direction of the force of gravity.

U.S. Pat. No. 7,014,085 discloses an explosion-actuated setting tool having a housing, an elongate holder projecting therefrom, and a ball-controlled safety locking device which permits the setting tool to be actuated only in a vertical or almost vertical orientation opposite to the direction of the force of gravity. The ball of the ball-controlled device is arranged in an annular receiving space between the holder and the housing.

The drawback of the setting tool of U.S. Pat. No. 7,014,085 consists in that the diameter of the ball defines the maximum movement path of the holder relative to the housing which is available in the release position of the ball and within which all of the necessary functions such as, e.g., initiating of ignition, must be carried out. Therefore, a very high pressing force is needed for this short movement path.

Another drawback consists in that widely differing angles result when the setting tool is lifted upward until released, and when the setting tool is lowered until blocked again; that is, the limiting angle at which a setting process is still possible when the setting tool deviates from a vertical orientation opposite to the direction of the gravitational force, can vary depending on the changes in orientation of the setting tool prior to actuation. Moreover, when the setting tool is pressed, with a jerk, horizontally against a wall or downwardly against a floor, the blocking ball rolls out of its blocking position, and the setting tools becomes inadvertently released.

SUMMARY OF THE INVENTION

An object of the present invention is a positioning and actuation device of the type mentioned above which overcomes the drawbacks described above and which makes possible a sufficiently long movement path of the holder relative to the setting tool when pressing against a workpiece while at the same time requiring a small expenditure of force.

This and other objects of the present invention, which will become apparent hereinafter, are achieved, according to the invention, by providing a positioning device the safety device of which includes a least three separate channels and at least three blocking members displaceable in the at least three separate channels, respectively, with the switching member having a recess for receiving the blocking members and which opens toward the structural component, with the at least three channels being inclined with respect to a plane extending perpendicular to the longitudinal axis and with the at least three channel intersecting in some regions, an axial projection of the switching member in form of a secant and opening toward the switching member in the respective overlapping regions. The intersection of the axial projection of the switching member by the channels in form of a secant means that the channels do not extend toward the axis of the switching member but rather intersect its axial projection along periphery.

The novel features of the present invention insure, on one hand, that a blocking position of the safety device is reached not only at a certain orientation of the positioning device but also rotationally symmetrically with respect to the longitudinal axis in other tilting positions that deviate from the predetermined orientation. This is because at least one blocking member always lies in the overlapping region of a respective channel and extends thus, into the recess of the switching member. Thus, e.g., the blocking position is always then actuated when the positioning device is moved in a tilting position relative to a vertical (i.e., with respect to the orientation in a direction opposite to the vector of the gravitational force) that exceeds the maximum allowable tilting angle.

On the other hand, the maximum stroke of the switching member is not determined by the size of the blocking members. Therefore, the function, which is controlled by the press-on path such as, e.g., actuation of the setting tool or displacement of a cartridge in case of a powder charge-operated setting tool, can be determined based on an optimal force-path ratio. Thereby, a need in high pressure forces can be eliminated. It can also be desirable to be able to actuate the setting tool when the positioning device is oriented in the direction of the vector of the gravitational force and/or in a tilting, with respect to this orientation, position.

Advantageously, the at least three channels are distributed about the longitudinal axis rotationally symmetrically. Thereby, the blocking function provides for actuation of the safety device about its longitudinal axis at the same release angle in each rotational position.

Advantageously, the blocking members are formed as pin-shaped members. Thereby, a premature release of the blocking position can be prevented when the device is dynamically displaced against a wall or a floor, and the blocking members have a tendency, because of the occurring acceleration forces, to move out of their blocking position. This is because the pin-shaped blocking members contrary to the ball-shaped blocking members block the release over their entire axial length, thus, preventing the premature release of the blocking position.

It is further advantageous, when the structural component is formed as a coupling element having a cylindrical portion, and the switching member is formed as a rod-shaped member displaceable in the cylindrical portion of the coupling element. The coupling element forms a support along which a movable part of the switching link is guided. Thereby, the safety device insures that in case of blocking, the forces acting on the blocking member are smaller at an orientation that enables a setting process relatively far below the mass link.

Alternatively, the structural component can be formed, e.g., by a handle or by connection means.

It is advantageous, when the at least three channels are inclined to the plane which extends perpendicular to the longitudinal axis, each at an angle between 20° and 50°. This permits, on one hand, a reliable free switching at an orientation transverse to a direction opposite the direction of the vector of the gravitational force or at an orientation slightly inclined to this transverse orientation and, on the other hand, reliably blocks the actuation at an orientation perpendicular to the vector of the gravitational force (horizontal) orientation, or when a dynamic pressure acts in the direction of the gravitational force.

Advantageously, the overlapping region of a channel with respect to the axial projection of the switching member has a depth toward the longitudinal axis, smaller than a diameter of the channel. This insures a reliable guidance of the blocking members in the channels though the channels intersect in form of secant the axial projection of the switching member or the guide bore for the switching member.

It is further advantageous when the recess in the switching member is formed as an annular groove closed in both axial directions of the switching member. This insures a good access of the recess for the blocking members and their easy displacement from the channels into the recess for effecting blocking when the device is displaced in a position in which an actuation is not desired.

It is further advantageous when the recess in the switching member has walls that limit the recess in an axial direction and that are inclined to the longitudinal axis so that an axial width of the recess diminishes from a radially outward end to a radially inward end. Thereby, the pin-shaped blocking members have, in the blocking position, not a point but linear contact with the inclined walls of the recess. Thereby, the surface pressure in the contact region can be reduced.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
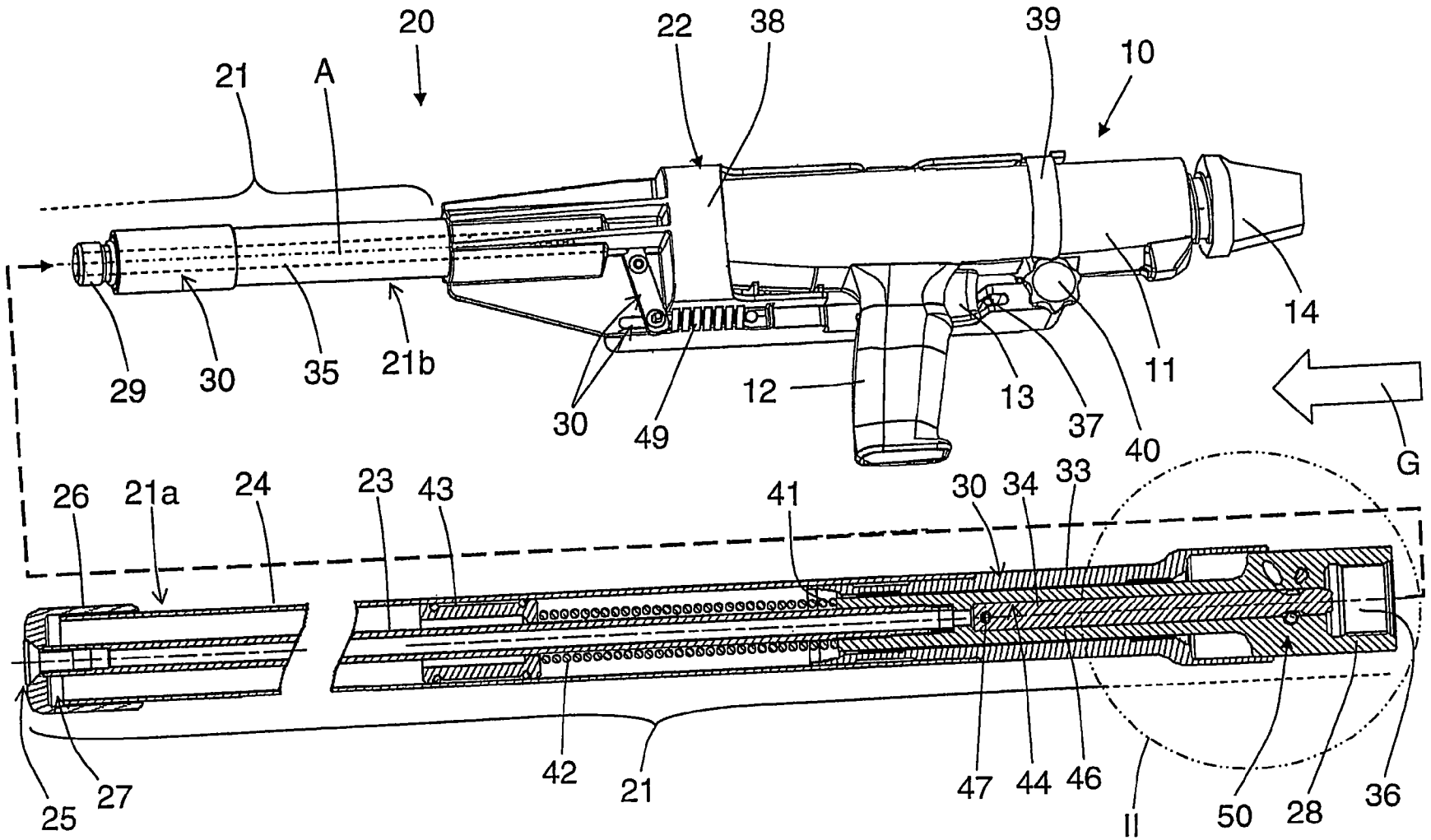
FIG. 1 a partially exploded view of the positioning device according to the invention with actuating switching means and with a hand-held setting tool, which is arranged at connection means, in a non-pressed position.

FIGS. 1 to 6 show a positioning device 20 according to the invention with actuating switching means for a hand-held setting tool 10 and which can be formed as a modular unit, for example. In the complete positioning device 20, the parts 21*a* and 21*b* of a rod-shaped holder 21, which are shown in FIG. 1, are coupled with one another by a coupling element 28 and a counter-coupling element 29. The connection between the coupling element 28 and the counter-coupling element 29 is releasable so that the positioning device 20 can be assembled and disassembled. A longitudinal extension of the rod-shaped holder 21 defines a longitudinal axis of the positioning device 20. Positioning devices 20 are used for carrying out overhead work on ceilings, etc. with the setting tool 10.

The setting tool 10 shown in FIG. 1 has a setting mechanism arranged in a housing 11, which can be formed of one or more parts, for driving fastening elements into a constructional component. An actuation switch 13 is arranged on a handle 12 of the setting tool 10 for actuating a setting process. A muzzle part, designated in its entirety by a reference numeral 14, is arranged on the setting tool 10 in front of the housing 11 and can be displaced relative to the housing 11. When the muzzle part 14 of the setting tool 10 is pressed against a construction component (not shown in the drawings), the condition of the setting tool 10 changes to a setting-ready state in which a setting process can be actuated by the actuation switch 13. The positioning device 20 has a switching link 30 that connects an actuation element 24 of the rod-shape holder 21 with the actuation switch 13 of the setting 10. Accordingly, the actuation element 24 acts as a remote actuation switch.

As can be seen in FIG. 1, the hand-held setting tool 10 is arranged at connection means 22 of the positioning device 20 and is releasably secured thereto by first holding element 38 and second holding element 39. The setting tool 10 can be detached from the connection means 22 by loosening the screw means 40 of the second holding element 39. Alternatively, the setting tool 10 can be connected with a positioning device by a threaded connection, with an inner thread being provided on the setting tool and an outer thread being provided on the positioning device or vice versa.

The actuation element 24 is provided on the first part 21*a* of the rod-like holder 21 and is formed as an elongated actuating sleeve, and is guided over a supporting element 23 of a supporting structure. The supporting element 23 is formed as a hollow bar. As an alternative to an actuating sleeve, an actuating lever could also be used and, e.g., arranged at a grip part at an end of the holder 21 remote from the coupling element 28.

The actuation element 24 is displaceable parallel to the longitudinal axis A relative to the supporting element 23. A base part 26, which projects beyond an axial end 27 of the actuation element 24 remote from the connection means 22 is arranged at a free end 25 of the supporting element 23 or the holder 21 remote from the connection means 22. The supporting element 23 is fixedly connected to a coupling element 28 which has a receptacle 36 for a counter-coupling element 29 at its end remote from the supporting element 23. A support point 41 for a spring element 42 is formed at an end of the coupling element 28 adjacent to the base part 26. The spring element 42 is supported with its other end against the actuation element 24 by an intermediate element 43 formed as an inner sleeve, and elastically loads the latter in direction of its initial position which is shown in FIG. 1. The intermediate element 43 is fixedly connected to the actuation element 24.

The actuation element 24 is connected to a sleeve-shaped, first switching member 33 of the switching link 30 which at least partially surrounds a portion 46 of the coupling element 28 that is secured to the supporting element 23. The first switching member 33 cooperates with a second switching member 34 of the switching link 30 which is formed as a pin and which is displaceably guided in a guide 44 in the coupling element 28 that is formed as a blind hole. The first switching member 33 is in turn connected to the second switching member 34 by a connection element 47 which extend perpendicular to the longitudinal axis A and is formed as a stud. The connection element 47 extends through slit-shaped opening (not shown) in the portion 46 of the coupling element 28 which make it possible for the connection means 47 to be displaced relative to the coupling element 28 and parallel to the longitudinal axis A.

The connection means 22 is provided on the second part 21*b* of the rod-shaped holder 21. At its end remote from the connection means 22, this second part 21*b* of the rod-shaped holder 21 has an annular counter-coupling element 29 which, as has already been described, can be inserted into the receptacle 36 of the coupling element 28. The connection between the coupling element 28 and the counter coupling element 29 is releasable, as it has been already mentioned above, so that the positioning device 20 can be assembled and disassembled.

Further, the second part 21*b* of the rod-shaped holder 21 has a third switching member 35 of the switching link 30 and which cooperates with the second switching member 34 when the coupling element 28 and the counter coupling element 29 are connected to one another. The third switching member 35 is rod-shaped and is guided in an interior space of the second part 21*b* of the rod-shaped holder 21. At the transition from the rod-shaped holder 21 to the connection means 22, the third switching member 35 can be coupled with additional switching members of the switching link 30 at least in the movement direction toward the connection means 22. Further, a driver 37, which cooperates with the actuation switch 13 of the setting tool 10 arranged at the connection means 22, is provided at a free end of the switching link 30 at the connection means 22. Spring means 49 biases the switching link 30 at the connection means 22 and the driver 37 in direction of its inactive position, shown in FIG. 1, in which the driver 37 does not press against the actuation switch 13 of the setting tool 10.

In addition to the first part 21*a* and the second part 21*b*, the holder 21 can have one or more elongate parts which can be arranged between the first and second parts 21*a*, 21*b* and be provided, at their respective ends, with respective coupling and counter-coupling elements and with respective further switching members of the switching link displaceable thereat.

Further, the positioning device 20 has a safety device, designated in its entirety by 50 (see especially FIGS. 2 to 6), which prevents the setting tool 10 arranged at the positioning device 20 from being actuated by the actuation element 24 at an orientation other than the permitted orientation. This safety device 50 is arranged between a structural component of the supporting structure, which is formed, in the shown embodiment, as a portion 46 of the coupling element 28 remote from the receptacle 36, and a switching member of the switching link 30 which is displaceable axially along the longitudinal axis A and is formed by the second switching member 34 in the disclosed embodiment. The safety device 50 includes an annular recess 51 on the radial outer side of the second switching member 34. The annular recess 51 opens toward the portion 46 or radially outwardly.

Figure 2:
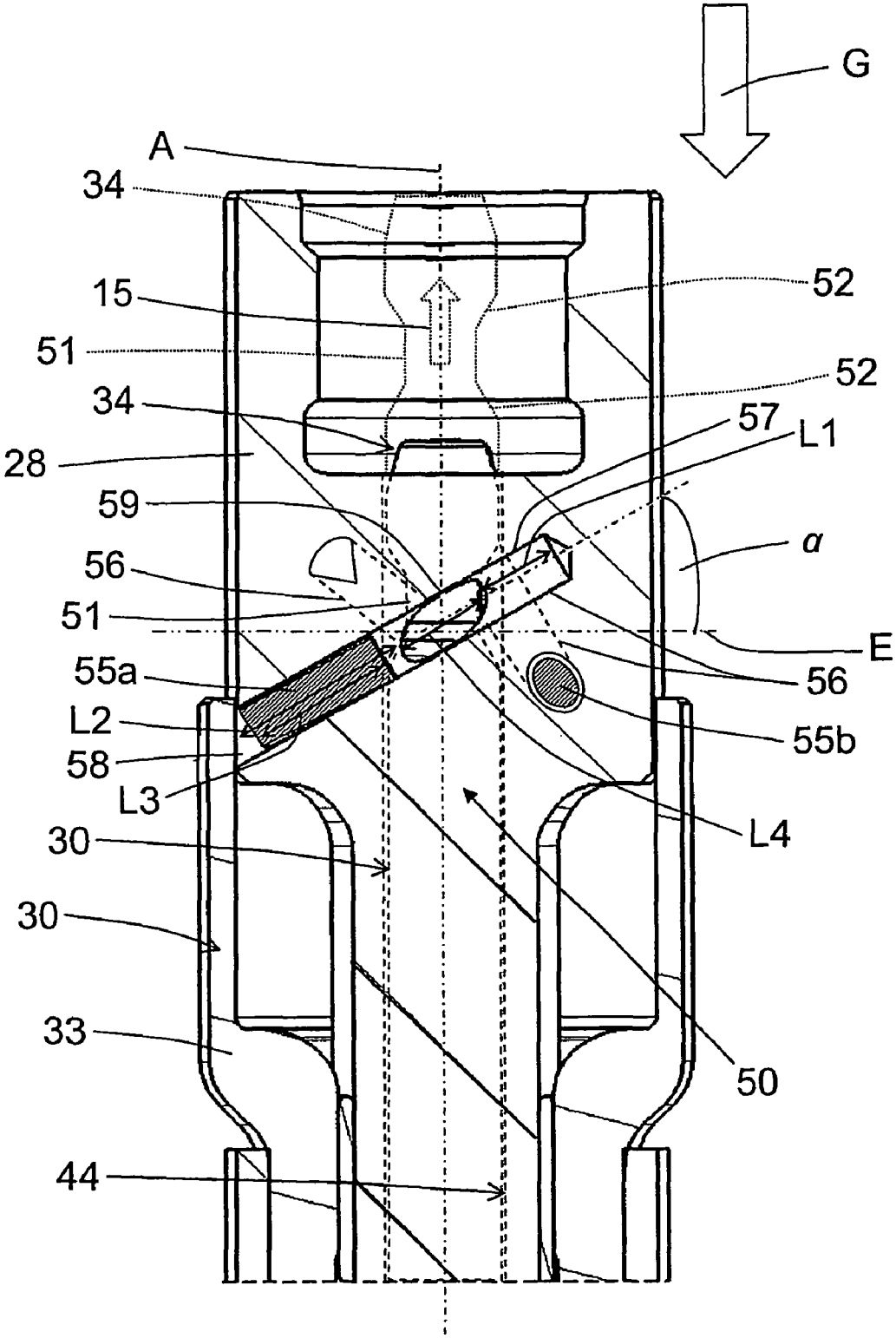
FIG. 2 a cross-sectional longitudinal, parallel to the longitudinal axis, view at an increased, in comparison with FIG. 1, scale, of a detail of the positioning device according to the invention in a non-actuated position and with indication of an actuated vertical orientation of the positioning device in a direction opposite the direction of the gravitational force.
Figure 3:
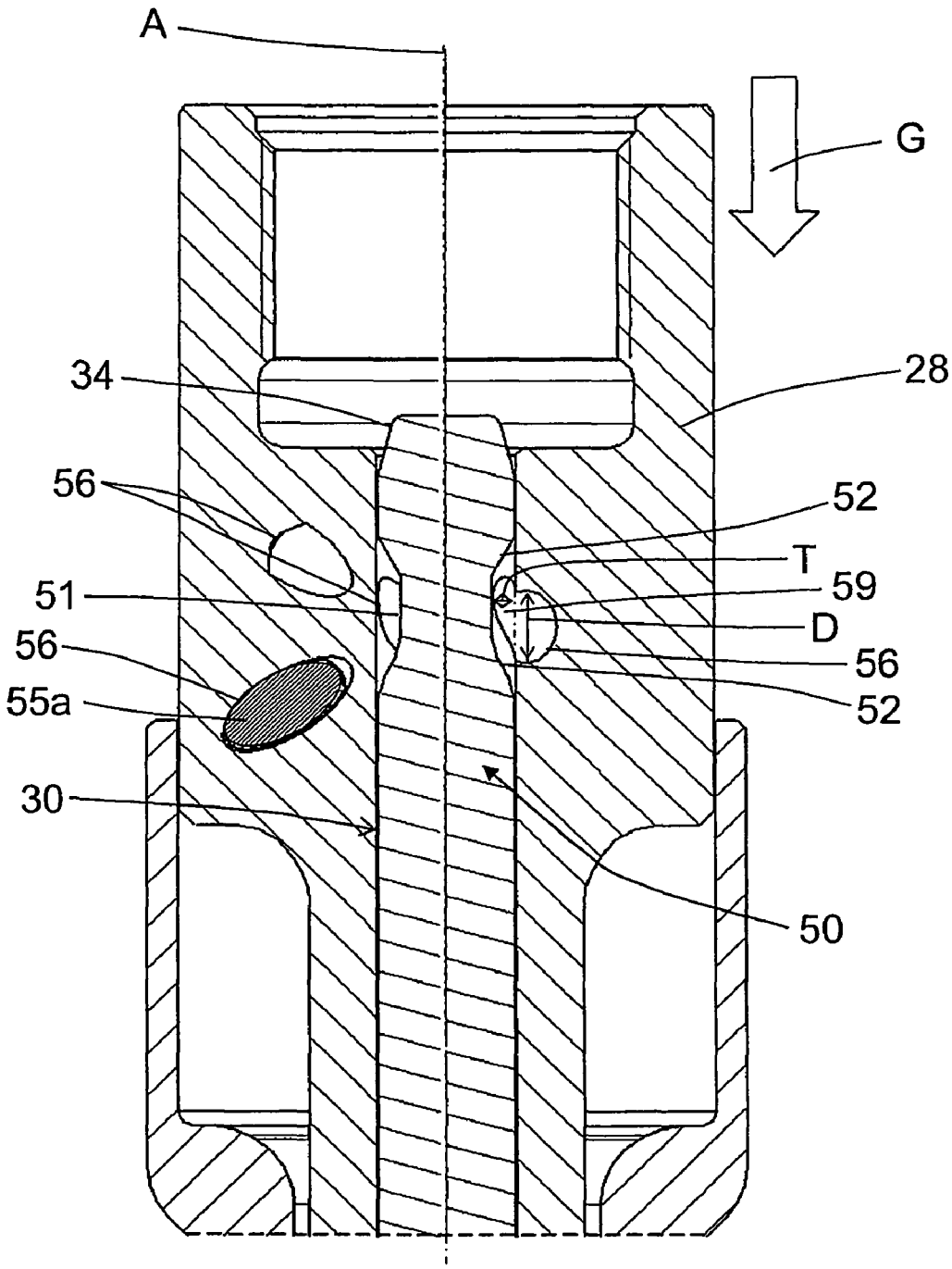
FIG. 3 a cross-sectional longitudinal view of the detail of the positioning device shown in FIG. 2 in the non-actuated position.
Figure 4:
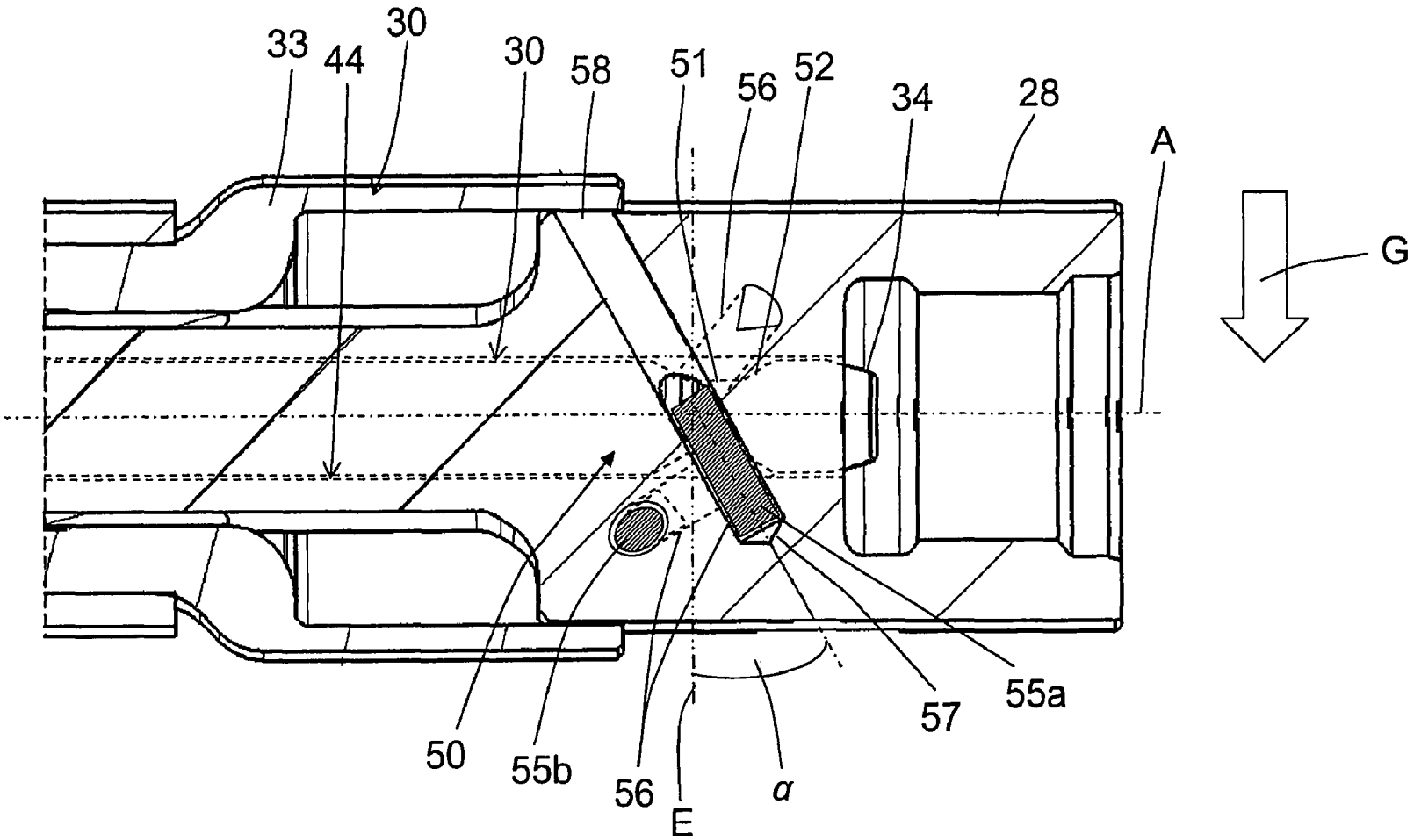
FIG. 4 a cross-sectional longitudinal, parallel to the longitudinal axis, view of the detail of the positioning device shown in FIG. 2 in the non-actuated position at a horizontal orientation.
Figure 6:
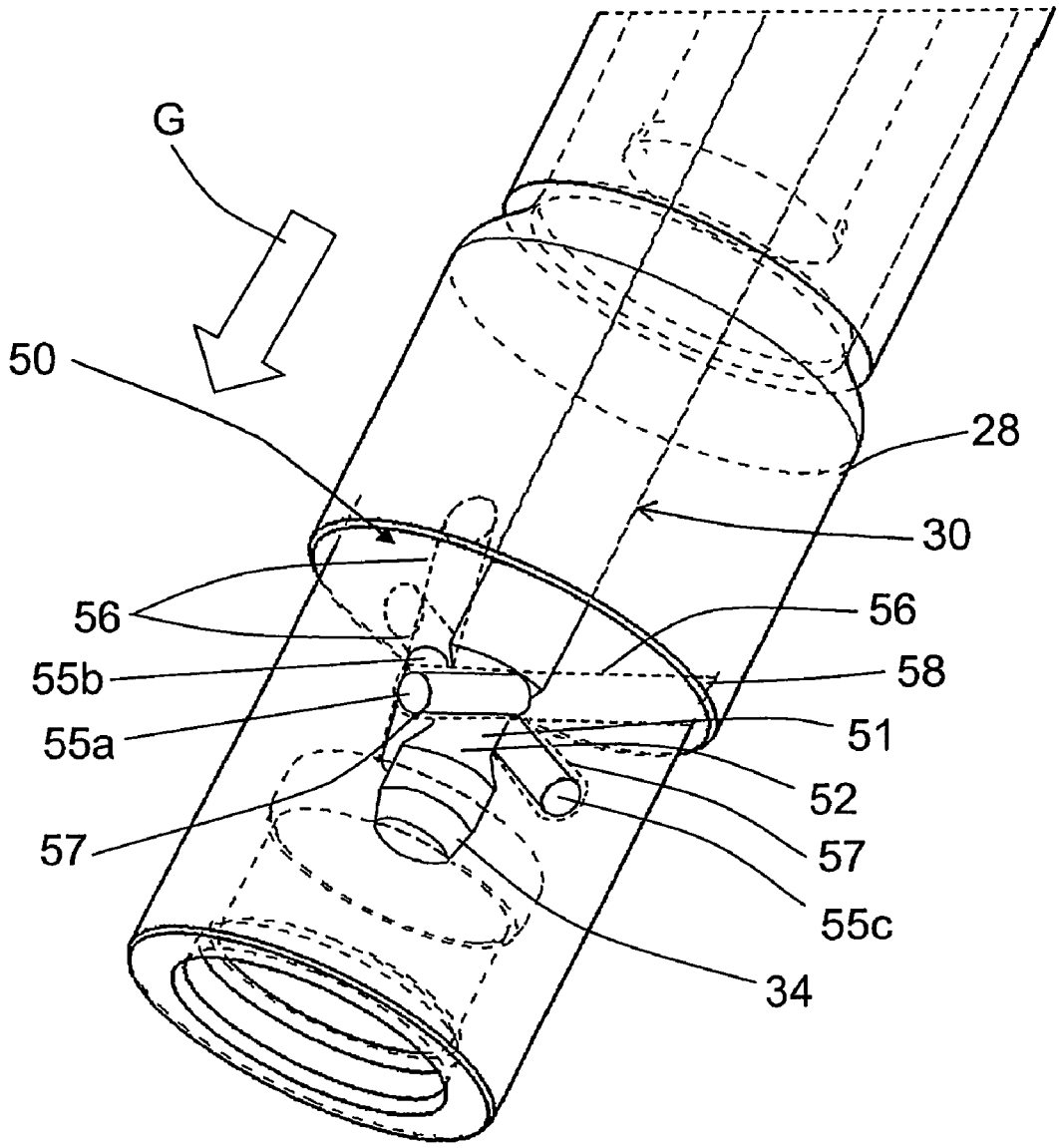
FIG. 6 a perspective view of a detail of the positioning device shown in FIG. 5, in a non-actuated position.

The safety device 50 further has a plurality of channels 56, exactly three in the shown embodiment, which are provided in the portion 46 of the coupling element 28, are distributed rotationally symmetrically about the axis A, and are inclined at angle $\alpha$ from 20° to 50° to a plane E extending perpendicular to the axis A (see in particular FIGS. 2, 4, and 6). The channels 56 have, perpendicular to their longitudinal extent, a circular cross-section. A radially outer end of the channels 56 is open at an outer surface of the coupling element 28 in the region of the portion 46, and the radial inner end 57 of the channels 56 is closed. The channels 56 intersect in the form of a secant, in some regions, an axial projection of the second switching member 34 and are open toward the second switching member 34 in these overlapping regions 59. A length L2 of the channels 56 from its radially outer end 58 toward the overlapping region 59 is greater than a length L1 of the channel 56 from its inner end 57 toward the overlapping region 59 (see FIG. 2). The overlapping regions 59 of the channels 56 and the axial projection of the second switching member 34 have, toward the axis A, a depth T that is smaller than a diameter D of the channels 56 (see in particular FIG. 3). A blocking member 55*a*, 55*b*, 55*c*, which is formed as an elongate, cylindrical pin, is displaceably arranged in each channel 56. The length L1 of the channels 56 from the inner end 57 toward the overlapping region 59 is smaller than a length L3 of the pin-shaped blocking member 55*a*, 55*b*, 55*c* (see FIG. 2). Further, a length L4 of the overlapping channel 59 in the longitudinal direction of the channel 56 is smaller than the length L3 of the pin-shaped blocking member 55*a*, 55*b*, 55*c*.

In the initial position of the positioning device 20 shown in FIGS. 1-3, the positioning device 20 is oriented with the muzzle part 14 of the setting tool 10 in a direction opposite the direction of the vector G of the force of gravity (e.g., in a direction of a ceiling). The actuation element 24 is inactive and is displaced into the cup-shaped base part 26 to the maximum distance by the spring element 42. Therefore, the second switching member 34 is moved into the guide 44 in the coupling element 28 likewise by the maximum distance. The third switching member 35 and the rest of the switching link 30 with the driver 37 following in the direction of an actuation stroke are inactive.

FIGS. 2 and 3 show an enlarged view of an area of the positioning device 20 with the safety device 50 being oriented with respect to the vector G of the gravitational force, as shown in FIG. 1. As shown, the pin-shaped blocking member 55*a* is located in the channel 56, extending radially outwardly in a region adjacent to the radially outer end 58 and, thus, without blocking the overlapping region 59 between the portion 46 and the second switching member 34. The other blocking members 55*b*, 55*c* (in FIG. 2, the blocking member 55*c* is located outside of the cross-sectional plane and is, therefore, not visible) are also located radially outwardly in the respective channels 56 in regions adjacent to respective outer ends 58, likewise not blocking the respective overlapping regions 59. The safety device 50 is located at this orientation of the positioning device in its actuation-permitting position. The setting tool 10, which is attached to the positioning device, can be pressed, at this orientation, with its muzzle part 14 against a ceiling or another constructional component and can be actuated by displacement of the actuation element 24 in a direction of the coupling element 28 because the blocking members 55*a*, 55*b*, 55*c* permit a relative movement of the second switching member 34 with respect to the component of the support structure or relative to the portion 46 of the coupling element 28 due to their position outside of the first recess 51. As shown in FIG. 2, the second switching member 34 is displaced by the actuation element 24 and by the first switching member 33 in direction of a first arrow 15 relative to the coupling element 28 and its portion 46 (the second switching member 34 is shown with dash lines). The second switching member 34 displaces the following portion of the switching link 30 up to the driver 37 for the actuation switch 13 (not shown in FIGS. 2 and 3). Thus, at this orientation of the positioning device 20 relative to the vector G of the gravitational force, the setting tool 10 can be actuated.

Even when the positioning device 20 is inclined relative to the orientation shown in FIGS. 1-3, maximum at about 25°-50°, an actuation is still possible. This is because the pin-shaped blocking numbers 55*a*, 55*b*, 55*c* remain in the regions of the channels 56 adjacent to the radially outer ends 58. If a pin-shaped blocking member 55*a*, 55*b*, 55*c* would only partially, i.e., with an end, extend in the overlapping channel 59, the safety device 50 still would remain in its release position, so that the blocking member can be pressed out into a release position upon application of pressure to a groove wall 52 of the recess 51, which extends at an angle to the axis A.

In FIG. 4, the positioning device 20 together with the safety device 50, extends with its axis A, e.g., at right angle to the vector G of the gravitational force. As shown, one of the pin-shaped blocking members, namely, the blocking member 55*a*, is located in a region of the channel 56 adjacent to the inner end 57 of the channel 56. Therefore, due to the relationship of the length L3 of the blocking member to the length L1 from the inner end 57 to the overlapping region 59, the blocking member 55*a* at least partially blocks the overlapping region 59. Thus, the safety device 50 is in its blocking position. If the setting tool 10, which is attached to the positioning device 20, is pressed with its muzzle part 14 against a constructional component at this orientation, a setting process cannot be initiated by movement of the actuation element 24 of the coupling element 28. This is because the blocking member 55*a*, due to its position in the recess 51, in the blocking position, provides only for a very short path of displacement of the second switching member 34 relative to a component of the support structure or relative to portion 46 of the coupling element 28. This very short path is much shorter than that necessary for the switching stroke of the second switching member 34.

Figure 5:
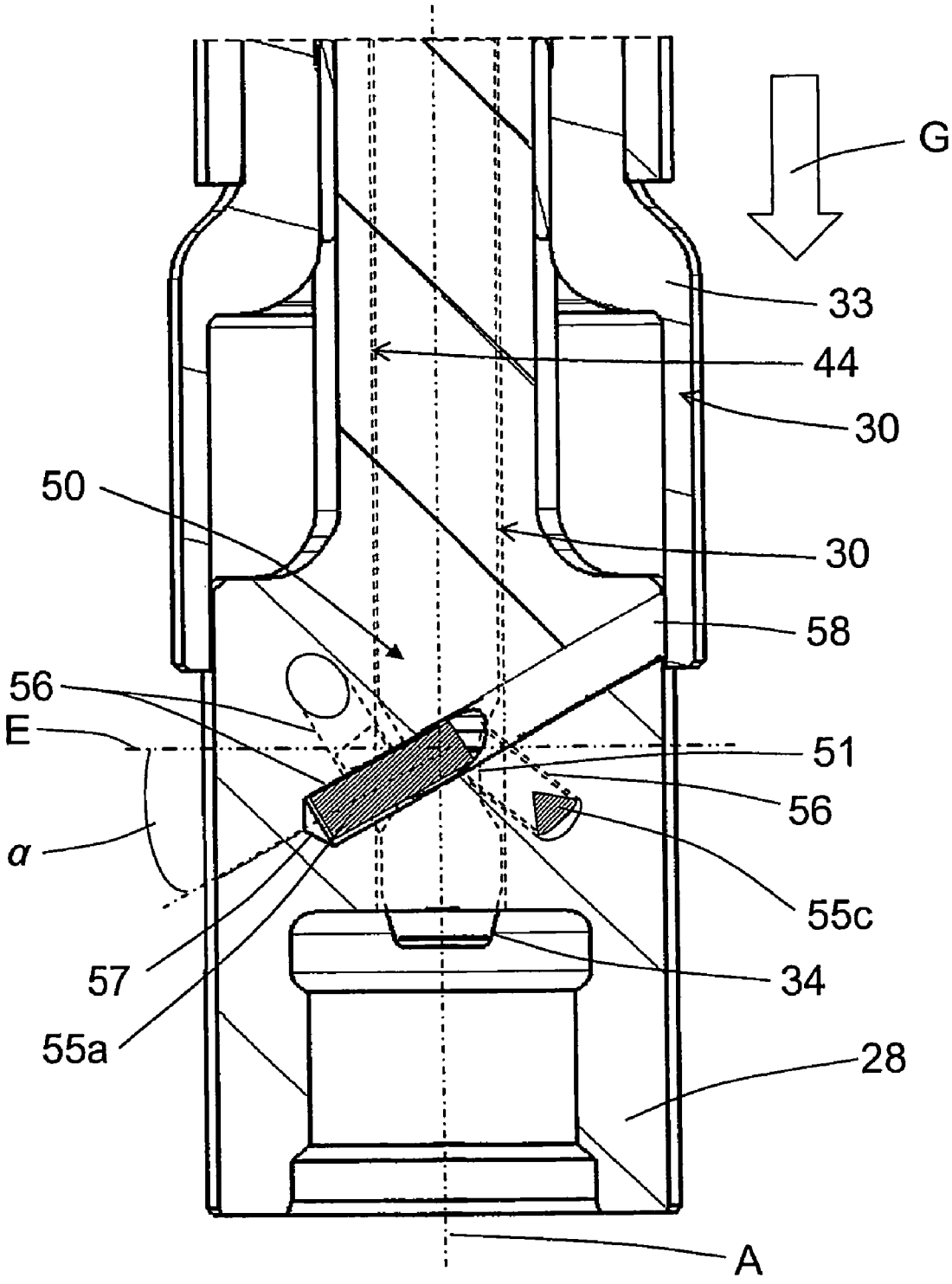
FIG. 5 a cross-sectional longitudinal, parallel to the longitudinal axis, view of a detail of the positioning device shown in FIG. 2 with a vertical orientation of the positioning device in a direction of action of the gravitational force.

In FIGS. 5-6 the positioning device 20, together with the safety device 50, is oriented with its axis A in the direction of the vector G of the gravitational force. As shown, all of the blocking members 55*a*, 55*b*, 55*c* are located in the regions of the respective channels 56 adjacent to the respective inner ends 57 of the respective channels 56. Therefore, due to the relationship of the length L3 of the respective blocking members 55*a*, 55*b*, 55*c* to the length L1 from the inner end 57 for the overlapping region 59, the blocking members 55*a*, 55*b*, 55*c* at least partially block the respective overlapping regions 59. Thus, the safety device 50 is in its blocking position also at this orientation. If the setting tool 10, which is attached to the positioning device 20, is pressed with its muzzle part 14 against a constructional component at this orientation, a setting process cannot be initiated by movement of the actuation element 24 of the coupling element 28. This is because the blocking members 55*a*, 55*b*, 55*c* due to their position in the recess 51, in the blocking position, provides only for a very short path of displacement of the second switching member 34 relative to a component of the support structure or relative the portion 46 of the coupling element 28. This very short path is much shorter than that necessary for the switching stroke of the second switching member 34.

FIG. 6 shows also a constructional variation of channels 56. In FIG. 6, the channels 56 conically expand at their radially inner ends 57, so that the central axes of the pin-shaped blocking members 55*a*, 55*b*, 55*c* can incline to center axes of respective channels 56. Thereby, upon a dynamic pressure of the positioning device 20 with the setting tool 10 in the direction of the vector G of the gravitational force or transverse thereto, the blocking time, during which at least one pin-shaped blocking member 55*a*, 55*b*, 55*c* at least partially blocks the overlapping region 59, becomes longer because the blocking member 55*a*, 55*b*, 55*c* firstly, should align with respect to the central axis of the channel 56 before it can be withdrawn from the channel 56.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A positioning device for a hand-held setting tool (10) having an actuation switch (13) for actuating the setting tool (10), the positioning device comprising a rod-shaped holder (21) defining a longitudinal axis (A); connection means (22) for connecting the positioning device with the setting tool (10) arranged at an end of the holder (21); switching means for actuating the actuation switch (13) and including an actuation element (24), a switching link (30) for connecting an actuation element (24) with the actuation switch (13) of the setting tool (10) and having a switching member (34) displaceable along the longitudinal axis (A) relative to a stationary, with respect to the holder, structural component; and a safety device (50) for preventing actuation of the actuation switch (13) at an orientation other than a predetermined orientation of the setting tool (10) and including at least three separate channels (56), and at least three blocking members (55*a*, 55*b*, 55*c*) displaceable in the at least three separate channels (56), respectively, the switching member (34) having a recess (51) for receiving the blocking members (55*a*, 55*b*, 55*c*) and which opens toward the structural component, wherein the at least three channels (56) are inclined with respect to a plane (E) extending perpendicular to the longitudinal axis (A), and wherein the at least three channels (56) intersect, in some regions, an axial projection of the switching member (34) in the form of a secant and are open toward the switching member (34) in respective overlapping regions (59).

2. A positioning device according to claim 1, wherein the at least three channels (56) are distributed about the longitudinal axis (A) rotationally symmetrically.

3. A positioning device according to claim 1, wherein the blocking members (55*a*, 55*b*, 55*c*) are pin-shaped.

4. A positioning device according to claim 1, wherein the structural component is formed as a coupling element (28) having a cylindrical portion (46), and the switching member (34) is formed as a rod-shaped member displaceable in the cylindrical portion (46) of the coupling element (28).

5. A positioning device according to claim 1, wherein the at least three channels (56) are inclined to the plane (E), which extends perpendicular to the longitudinal axis (A), each at an angle ($\alpha$) between 20° and 50°.

6. A positioning device according to claim 1, wherein an overlapping region of each channel (56) with respect to the axial projection of the switching member (34) on the longitudinal axis (A) has a depth (T) smaller than a diameter (D) of the channel (56).

7. A positioning device according to claim 1, wherein the recess (51) in the switching member (34) is formed as an annular groove closed at opposite axial ends thereof.

8. A positioning device according to claim 1, wherein the recess (51) in the switching member (34) has walls (52) that limit the recess (51) in an axial direction and that are inclined to the longitudinal axis (A) so that an axial width of the recess (51) diminishes from a radially outward side to a radially inward side.

* * * * *